United States Patent [19]

Addiego

[11] Patent Number: 4,726,511

[45] Date of Patent: Feb. 23, 1988

[54] PACKET HOLDING TRAY

[75] Inventor: Joseph Addiego, Monsey, N.Y.

[73] Assignee: Nabisco Brands, Inc., Parsippany, N.J.

[21] Appl. No.: 487,433

[22] Filed: Apr. 21, 1983

[51] Int. Cl.[4] ..... B65D 5/00

[52] U.S. Cl. ..... 229/161; 229/104

[58] Field of Search ..... 229/30, 41 R, 41 B, 229/31 FS, 27, 104, 161; 206/45.19, 45.25, 45.26, 514; 248/152, 174, 459

[56] References Cited

U.S. PATENT DOCUMENTS

| | | | |
|---|---|---|---|
| 1,908,841 | 5/1933 | Hawks | 229/30 |
| 2,708,085 | 5/1955 | Bonaccorsi | 248/459 X |
| 2,711,819 | 6/1955 | Vander Lugt, Jr. | 229/30 X |

FOREIGN PATENT DOCUMENTS

| | | | |
|---|---|---|---|
| 1028298 | 3/1978 | Canada | 229/30 |
| 2418748 | 11/1979 | France | 229/27 |
| 716280 | 9/1954 | United Kingdom | 248/152 |
| 2059921 | 4/1981 | United Kingdom | 229/31 FS |

*Primary Examiner*—Stephen Marcus
*Assistant Examiner*—Gary E. Elkins
*Attorney, Agent, or Firm*—Richard Kornutik

[57] ABSTRACT

A tray for holding individual serving packets which is formed by folding a one piece paperboard blank. The blank is cut and scored to provide horizontal edge strips, downwardly angled end strips, a central product supporting strip extending between the end strips and stiffening members connected along fold lines to both the edge strips and the end strips.

9 Claims, 7 Drawing Figures

PACKET HOLDING TRAY

BACKGROUND OF THE DISCLOSURE

The present invention relates to paperboard trays and more particularly to such trays which are formed from one piece blanks and retain their shape without gluing or interlocking any of their component parts.

Most paperboard tray constructions require the gluing or interlocking of component parts in order for the tray to retain its shape. The gluing or interlocking operation requires extra steps in the formation of the tray. In addition, the glued or interlocked sections comprise two or more layers of paperboard which represent an increased paperboard requirement. Frequently the paperboard requirement is further increased because the glued or interlocked components require that the blank be irregular in shape so as to require waste strips between adjacent blanks.

Gluing or interlocking operations and the paperboard requirements for such constructions add significantly to the cost of manufacturing paperboard trays.

SUMMARY OF THE INVENTION

It is an object of the present invention to provide a simple and inexpensive tray formed from a one piece paperboard blank without the gluing or interlocking of elements.

It is another object to provide such a tray from a paperboard blank which generates no paperboard waste.

The objects of the present invention are accomplished by providing a tray produced by folding a rectangular one piece paperboard blank which is cut and scored to provide horizontal edge strips, downwardly angled end strips, a central product supporting strip extending between the end strips, and stiffening members connected along fold lines to both the edge strips and the end strips.

BRIEF DESCRIPTION OF THE DRAWINGS

A preferred embodiment of the invention has been chosen for purposes of illustration and description, and is shown in the accompanying drawings, forming a part of the specification, wherein.

DESCRIPTION OF THE PREFERRED EMBODIMENT

Figure 1:
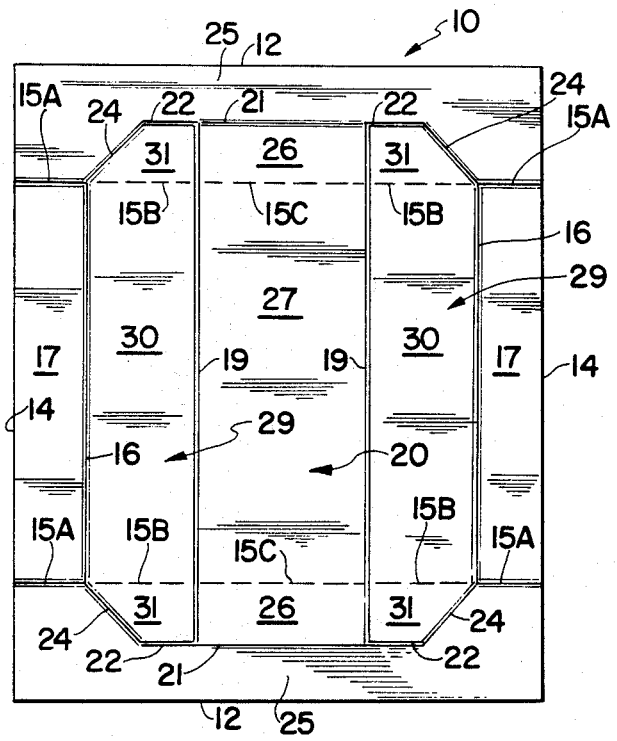
FIG. 1 is a plan view of the cut and scored paperboard blank before folding.
Figure 2:
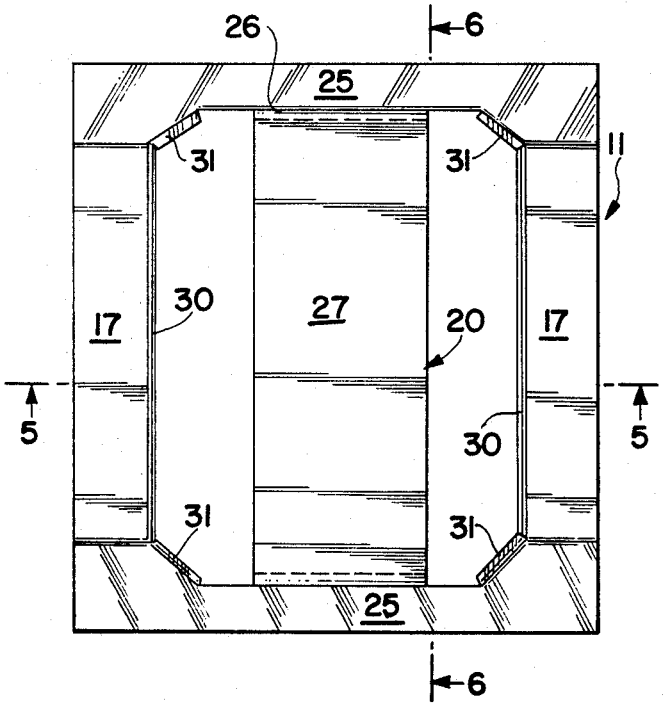
FIG. 2 is a plan view of the tray formed by folding the blank of FIG. 1.
Figure 3:
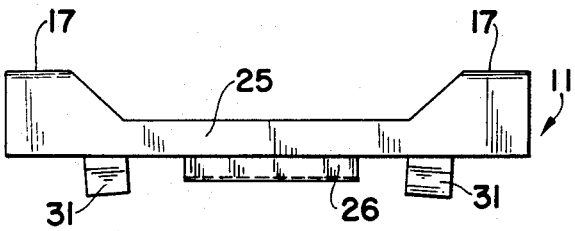
FIG. 3 is a front elevational view of the tray of FIG. 2.

Referring to the drawings in detail, there is shown a paperboard blank 10 and a tray 11 formed from the blank which are in accordance with the present invention.

The paperboard blank 10, as shown in FIG. 1, is rectangular in shape having ends 12 and edges 14. A first pair of parallel fold lines 15, each having segments

15A, 15B and 15C, extend across the blanks from edge to edge. A second pair of parallel fold lines 16 extend between the fold lines 15 perpendicular thereto defining strips 17. A first set of cut lines 19 parallel to the second fold lines 16 and positioned inwardly thereof extend past the first fold lines 15 to form a central strip 20. A third pair of fold lines 21 extend between the ends of the cut lines 19. A cut line 22 extends from each end of each cut line 19 toward the adjacent edge 14 in line with the fold lines 21. A fourth fold line 24, extends from the outer end of each cut line 22 to the end of the adjacent second fold line 16 at an angle of about 45 degrees to the line 16.

Figure 4:
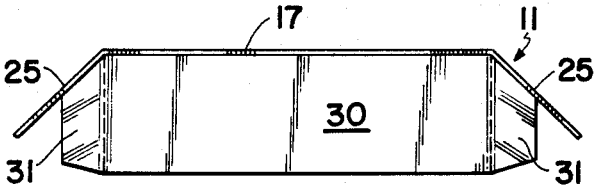
FIG. 4 is a side elevational view of the tray of FIG. 2.
Figure 5:
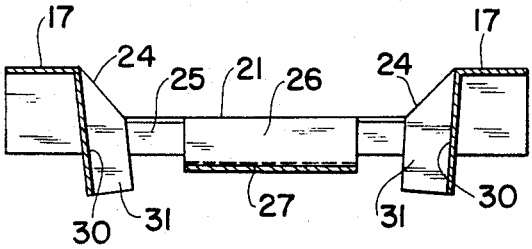
FIG. 5 is a sectional view taken along line 5—5 on FIG. 2.

End strips 25 are defined at each end of the blank 10 by the fold lines 21, the cut lines 22, the fold lines 24, and the fold line segment 15A outwardly of lines 16. The fold line segments 15A together with the fold lines 21 and 24 are scored to allow the end strips 25 to be folded downwardly to form downwardly facing oblique angles between the strips 25 and the strips 17 as shown in FIG. 4.

Figure 6:
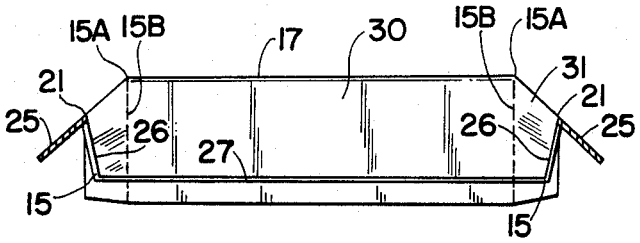
FIG. 6 is a sectional view taken along line 6—6 on FIG. 2.
Figure 7:
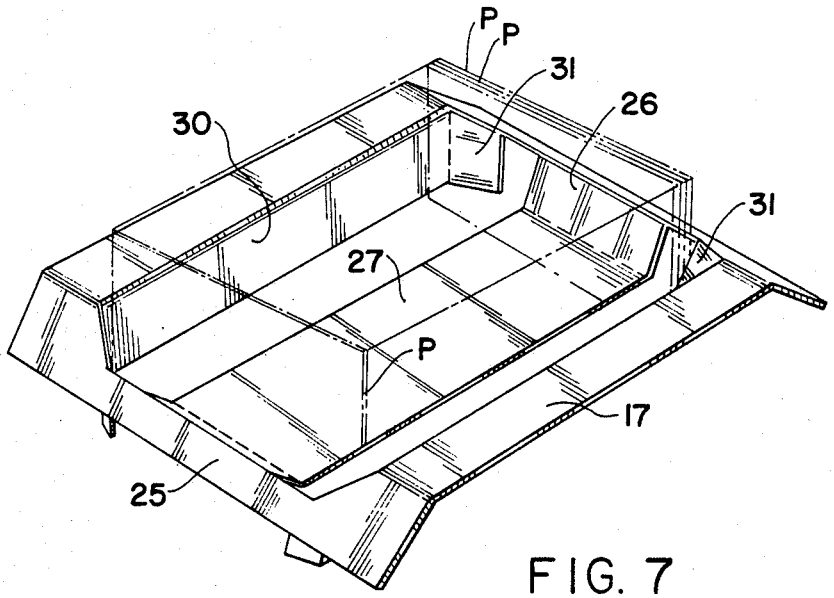
FIG. 7 is a perspective view showing the tray in use.

The fold line segments 15B and 15C lying inwardly of the lines 16 are scored to fold in the opposite direction to form generally upwardly facing oblique angles. The fold line segments 15C divide the central strip 20 into end support portions 26 and a floor portion 27. The fold lines 21 are scored to permit the end portions 26 (as best shown in FIG. 6) to fold downwardly with respect to the strip 25 along the fold lines 21, and upwardly with respect to the floor portion 27 along the fold line segment 15C.

A pair of stiffening wall members 29 are defined by the cut lines 19, 22 and by the fold lines 16, 24. The stiffening wall members 29 are divided by the fold line segments 15B into central sections 30 and end sections 31. The fold lines 16 are scored to permit the central sections 30 to fold downwardly with respect to the strips 17. The scoring along fold lines 24 allow the end sections 31 to fold downwardly with respect to the strips 25 while the scoring along the line segments 15B allows the end sections 31 to fold upwardly and inwardly with respect to the central sections 30.

The blank 10 is preferably cut from a sheet of paperboard by a die which simultaneously cuts and scores the blank. The blank is then preferably subjected to a pre-break operation to facilitate the forming of the tray. In the pre-break operation, reciprocating forming members produce a slight bend in the desired direction along each of fold lines. The blanks are still in an essentially flat condition so that a number of them can be included within the carton in which the product packets are shipped.

To complete the formation of a tray, the pre-broken blank is held between the thumb and fingers of one hand, the thumb engaging one end 12 and the fingers engaging the opposite end 12. The thumb and fingers are moved toward each other causing the blank to fold in the proper direction along each of the fold lines, into the shape shown in FIGS. 2 through 7.

After the tray 11 is formed, the stiffening wall members 29 tend to hold the tray in its assembled condition. The formed tray is loaded with packets P which are shown in phantom lines in FIG. 7.

Preferably, the packets P are made of a relatively stiff material, for example, paper, so that they have a degree of rigidity. They can contain individual servings of commonly used edible products such as sugar, sugar substitutes, salt substitutes, or the like. The packets are placed in the tray on edge upon the floor portion 27 of the central strip 20. The ends of the packets engage the central sections 30 of the stiffening wall members 29 to add further rigidity to the tray. The loaded tray is then placed in use on a counter or table, for example, in a cafeteria.

It will be seen from the foregoing that the present invention provides a simple and inexpensive tray formed from a one piece blank without gluing or interlocking of elements and without generating paperboard waste.

I claim:

1. A product holding tray produced by folding a rectangular one piece paperboard blank which is cut and scored to provide horizontal edge strips, at least two downwardly angled end strips, a central product supporting strip extending between said end strips, and stiffening members each connected along fold lines to a respective one of said edge strips and to both said end strips, said stiffening members having a central section and end sections connected to said central section along fold lines.

2. A tray according to claim 1 wherein said end strips are connected to said edge strips along fold lines.

3. A tray according to claim 2 wherein said fold lines connected said edge and end strips are in alignment with said fold lines connecting said stiffening member sections.

4. A product holding tray formed from a one piece blank of rectangular paperboard comprising a pair of horizontal edge strips, a pair of end strips connected to said edge strips along fold lines and angled downwardly with respect to said edge strips, a central product supporting strip comprising end support portions depending downwardly from said end strips between said edge strips and a horizontal floor portion extending between said end support portions, and stiffening wall members facing said supporting strip, each having a central section connected to said edge strips along fold lines and extending downwardly therefrom and end sections connected to both said wall portions and said end strips along fold lines to cause the wall portions to move in unison with the end strips.

5. A tray according to claim 4 wherein said end sections of said stiffening wall members are disposed at oblique angles to said central section thereof.

6. A one piece blank for forming a product holder comprising a generally rectangular sheet of paperboard, a pair of spaced first fold lines extending across said sheet parallel to the ends thereof between opposite edges thereof, a pair of spaced parallel second fold lines extending between said first lines perpendicularly thereto, a pair of first cut lines parallel to said second fold lines and positioned inwardly thereof forming a central strip, said first cut lines extending past each of said first fold lines, a pair of third fold lines extending between the ends of said cut lines parallel to said first fold lines, a short second cut line extending outwardly from each end of each of the first cut lines perpendicularly thereto, and a fourth fold line extending from the end of each second cut line at an angle to the adjacent end of the adjacent second cut line, said blank being bent to form the display holder by bending the ends of the sheet downwardly at the first fold lines while bending the central strip downwardly at the third fold lines.

7. A blank according to claim 6 including edge strips between said edges and said second fold lines; end strips between said ends and lines extending between said edges along said first, third and fourth fold lines, and said second cut lines; and a pair of stiffening wall members on either side of said central strip each connected to a respective one of said edge strips along a respective one of said second fold lines and each connected to both said end strips along said fourth fold lines.

8. A blank according to claim 6 wherein said sheet of paperboard is scored along the portion of said first fold line between said second fold lines to produce a generally upwardly facing oblique angle, and said sheet is scored along the outer portions of said first fold lines to produce a generally downwardly facing oblique angle.

9. A blank according to claim 6 wherein said sheet is scored along said second, third and fourth fold lines to produce generally downwardly facing oblique angles.

* * * * *